US008443780B2

(12) United States Patent
Coldren et al.

(10) Patent No.: US 8,443,780 B2
(45) Date of Patent: May 21, 2013

(54) LOW LEAKAGE CAM ASSISTED COMMON RAIL FUEL SYSTEM, FUEL INJECTOR, AND OPERATING METHOD THEREFOR

(75) Inventors: Dana Coldren, Secor, IL (US); Alan Stockner, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 442 days.

(21) Appl. No.: 12/791,179

(22) Filed: Jun. 1, 2010

(65) Prior Publication Data

US 2011/0290211 A1 Dec. 1, 2011

(51) Int. Cl.
*F02B 3/00* (2006.01)
*F02B 3/06* (2006.01)

(52) U.S. Cl.
USPC ..... 123/299; 123/300

(58) Field of Classification Search
USPC ..... 123/456, 445, 446, 467, 468, 469, 123/299, 300, 514; 417/225–227; 239/533.2, 239/585.5
See application file for complete search history.

(56) References Cited

U.S. PATENT DOCUMENTS 5,413,076 A 5/1995 Koenigswieser et al.
5,441,028 A 8/1995 Felhofer
RE35,079 E 11/1995 Sverdlin
5,779,149 A 7/1998 Hayes, Jr.
6,065,436 A 5/2000 Koga et al.
6,439,202 B1 8/2002 Carroll, III et al.
6,467,461 B1 10/2002 Becker
6,520,152 B1 2/2003 Mahr et al.
6,532,938 B1 3/2003 Mahr et al.
6,644,282 B2 11/2003 Schwarz
6,668,805 B2 12/2003 Kato et al.
6,688,536 B2 2/2004 Coldren et al.
6,714,853 B2 3/2004 Geyer et al.
6,823,846 B2 11/2004 Mattes
6,959,695 B2 11/2005 Warner et al.
6,962,141 B2 11/2005 Kern
7,066,147 B2 * 6/2006 Magel ..... 123/446
RE39,373 E 11/2006 Yudanov et al.
7,263,974 B2 9/2007 Knight
7,293,547 B2 11/2007 Ibrahim
7,320,311 B2 1/2008 Futonagane et al.

(Continued)

OTHER PUBLICATIONS

SOE, Best of Both Worlds at Euro-6?, Latest News, Nov. 1, 2006, pp. 1-2, published on the World Wide Web at http://www.soe.org.uk/news/item.php?id=685, 2008.

(Continued)

*Primary Examiner* — Mahmoud Gimie
(74) *Attorney, Agent, or Firm* — Liell & McNeil

(57) ABSTRACT

A fuel system includes a plurality of fuel injectors each defining a nozzle supply passage, a nozzle outlet and a low pressure space. The fuel system includes a plurality of mechanically actuated pressure intensifiers each including a tappet and being positioned partially within one of the fuel injectors, and a common rail fluidly connecting with each of the fuel injectors. Each of the fuel injectors further includes an injection pressure control mechanism having an injection pressure control valve. Each injection pressure control valve blocks the corresponding pressure intensifier from the common rail and fluidly connects the pressure intensifier with the low pressure space at a first position, and fluidly connects the pressure intensifier with the common rail and blocks the pressure intensifier from the low pressure space at a second position. Injecting fuel via operating the fuel system may include operating the fuel system in a low leakage mode where the pressure intensifier displaces fuel at a low pressure, between high pressure injections.

21 Claims, 3 Drawing Sheets

U.S. PATENT DOCUMENTS

| | | | | |
|---|---|---|---|---|
| 7,404,393 | B2 * | 7/2008 | Moore | 123/446 |
| 7,461,634 | B2 | 12/2008 | Watanabe et al. | |
| 7,472,691 | B2 | 1/2009 | Nagatomo et al. | |
| 7,584,747 | B1 | 9/2009 | Ibrahim et al. | |
| 2004/0041037 | A1 | 3/2004 | Klugl et al. | |
| 2004/0065294 | A1 | 4/2004 | Winter et al. | |
| 2004/0178283 | A1 | 9/2004 | Bochland | |
| 2004/0195385 | A1 * | 10/2004 | Lawrence et al. | 239/533.2 |
| 2005/0028783 | A1 | 2/2005 | Sun et al. | |
| 2005/0120872 | A1 | 6/2005 | Stockner et al. | |
| 2005/0133629 | A1 | 6/2005 | Stringfellow | |
| 2005/0150972 | A1 | 7/2005 | Dong et al. | |
| 2005/0268888 | A1 | 12/2005 | Nakayama et al. | |
| 2006/0243253 | A1 | 11/2006 | Knight | |
| 2007/0175448 | A1 | 8/2007 | Shinogle et al. | |
| 2008/0011274 | A1 | 1/2008 | Goney et al. | |
| 2008/0099577 | A1 | 5/2008 | Feinleib | |
| 2009/0241903 | A1 | 10/2009 | Ibrahim et al. | |

OTHER PUBLICATIONS

SAE OHE, Delphi looks into diesel's future, Jun. 2007, pp. 6-8.

* cited by examiner

LOW LEAKAGE CAM ASSISTED COMMON RAIL FUEL SYSTEM, FUEL INJECTOR, AND OPERATING METHOD THEREFOR

TECHNICAL FIELD

The present disclosure relates generally to fuel systems and fuel system operating methods, for internal combustion engines, and relates more particularly to operating a common rail fuel system having a cam actuated pressure intensifier in a low leakage mode.

BACKGROUND

Many types of fuel injection systems for internal combustion engines have been developed over the years. Common rail fuel injection systems are well known and widely used in connection with multi-cylinder internal combustion engines. A typical common rail fuel system includes a low pressure fuel source, a high pressure pump and a common rail connecting the high pressure pump with a plurality of fuel injectors. Injection of fuel at rail pressure can occur relatively precisely by electronically controlling each of the fuel injectors coupled with the common rail. Common rail systems have seen widespread success in part because they provide a relatively simple and straightforward means for providing fuel to a plurality of fuel injectors, and enable injection of fuel at relatively precise times and injection amounts. Common rail systems have also proven to be a relatively efficient and effective way to handle relatively high fuel pressures. While known common rail systems have long served as an industry standard for high pressure fuel injection practices, there is room for improvement.

On the one hand, containing a volume of highly pressurized fuel can be relatively difficult, requiring specialized hardware such as seals and plumbing. Parts subjected to extremely high pressures may also have a tendency to wear relatively more quickly than parts used in lower pressure environments. It can also require significant engine output energy to maintain a relatively large volume of fuel at high pressure. Relying solely upon a common rail as a pressure source for fuel can ultimately impact engine efficiency.

Systems have been proposed where a common rail is used to supply fuel at a first pressure to a plurality of fuel injectors of an engine system. A hydraulically actuated or cam actuated pressure intensifier may also be used in such systems to enable fuel injection at selective times at a higher pressure. United States Patent Application Publication No. 2006/0243253 to Knight proposes incorporating a cam actuated piston to a common rail system to enable injection of fuel at rail pressure from the common rail, or at a higher pressure from the pressure intensifier. In Knight's system, the cam actuated pressure intensifier is also used to assist in maintaining the pressure of the common rail when it is not being used to directly elevate fuel pressure for an injection. As a result, the piston in Knight will apparently pump at high pressure continuously. Continuously subjecting components of the fuel system to high pressure from the piston in Knight may result in excessive leakage between and among certain components. Leakage of high pressure fuel as in Knight would tend to waste energy, as the engine output energy used to pressurize the leaked fuel cannot readily be recovered.

SUMMARY OF THE INVENTION

In one aspect, a method of operating a fuel system for an internal combustion engine includes injecting fuel into an engine cylinder at a medium pressure at least in part by fluidly connecting a nozzle outlet of a fuel injector with a common rail. The method further includes increasing a pressure of fuel in a plunger cavity of the fuel injector from a low pressure to the medium pressure by fluidly connecting the plunger cavity with the common rail, and increasing a pressure of fuel in the plunger cavity from the medium pressure to a high pressure by moving a tappet of the mechanically actuated pressure intensifier in response to rotation of a cam. The method further includes injecting fuel at the high pressure into the engine cylinder at least in part by fluidly connecting the nozzle outlet with the plunger cavity, and operating the fuel system in a low leakage mode subsequent to injecting fuel at the high pressure at least in part via returning a pressure of fuel in the plunger cavity from the high pressure to the low pressure.

In another aspect, a fuel injector includes an injector body defining a nozzle supply passage, a nozzle outlet connecting with the nozzle supply passage, a control passage and a low pressure space. The injector body further defines at least one fuel inlet connecting with the nozzle supply passage, a plunger cavity and a pressure intensification passage connecting the plunger cavity with the nozzle supply passage within the injector body. The fuel injector further includes a direct control needle check positioned within the injector body and movable between a closed position blocking the nozzle outlet from the nozzle supply passage, and an open position. The direct control needle check includes an opening hydraulic surface exposed to a fluid pressure in the nozzle supply passage, and a closing hydraulic surface exposed to a fluid pressure in the control passage. The fuel injector further includes a check control valve movable between a first injection control position at which the control passage is blocked from the low pressure space, and a second injection control position at which the control passage is open to the low pressure space. The fuel injector further includes a mechanically actuated pressure intensifier positioned partially within the injector body, the mechanically actuated pressure intensifier including a tappet and a plunger configured to move between a first plunger position and an advanced plunger position within the plunger cavity, in response to rotation of a cam. The fuel injector still further includes a one-way valve positioned fluidly between the pressure intensification passage and the nozzle supply passage and permitting fluid flow from the plunger cavity to the nozzle supply passage. The fuel injector still further includes an injection pressure control mechanism having a first pressure control configuration and a second pressure control configuration. The injection pressure control mechanism blocks the plunger cavity from the at least one fuel inlet and fluidly connects the plunger cavity with the low pressure space in the first pressure control configuration. The injection pressure control mechanism fluidly connects the plunger cavity with the at least one fuel inlet and blocks the plunger cavity from the low pressure space in the second pressure control configuration.

In still another aspect, a fuel system for an internal combustion engine includes a plurality of fuel injectors, each of the fuel injectors including an injector body defining a nozzle supply passage, a nozzle outlet connecting with the nozzle supply passage, and a low pressure space. The fuel system further includes a plurality of mechanically actuated pressure intensifiers each including a tappet and being positioned partially within one of the injector bodies, and a common rail fluidly connecting with each of the fuel injectors. Each of the fuel injectors further includes an injection pressure control mechanism having an injection pressure control valve movable between a first pressure control position and a second pressure control position. Each of the injection pressure control valves blocks the corresponding pressure intensifier from the common rail and fluidly connects the pressure intensifier with the low pressure space at the first pressure control position. Each of the injection pressure control valves fluidly connects the pressure intensifier with the common rail and blocks the pressure intensifier from the low pressure space at the second pressure control position.

DETAILED DESCRIPTION

Figure 1:
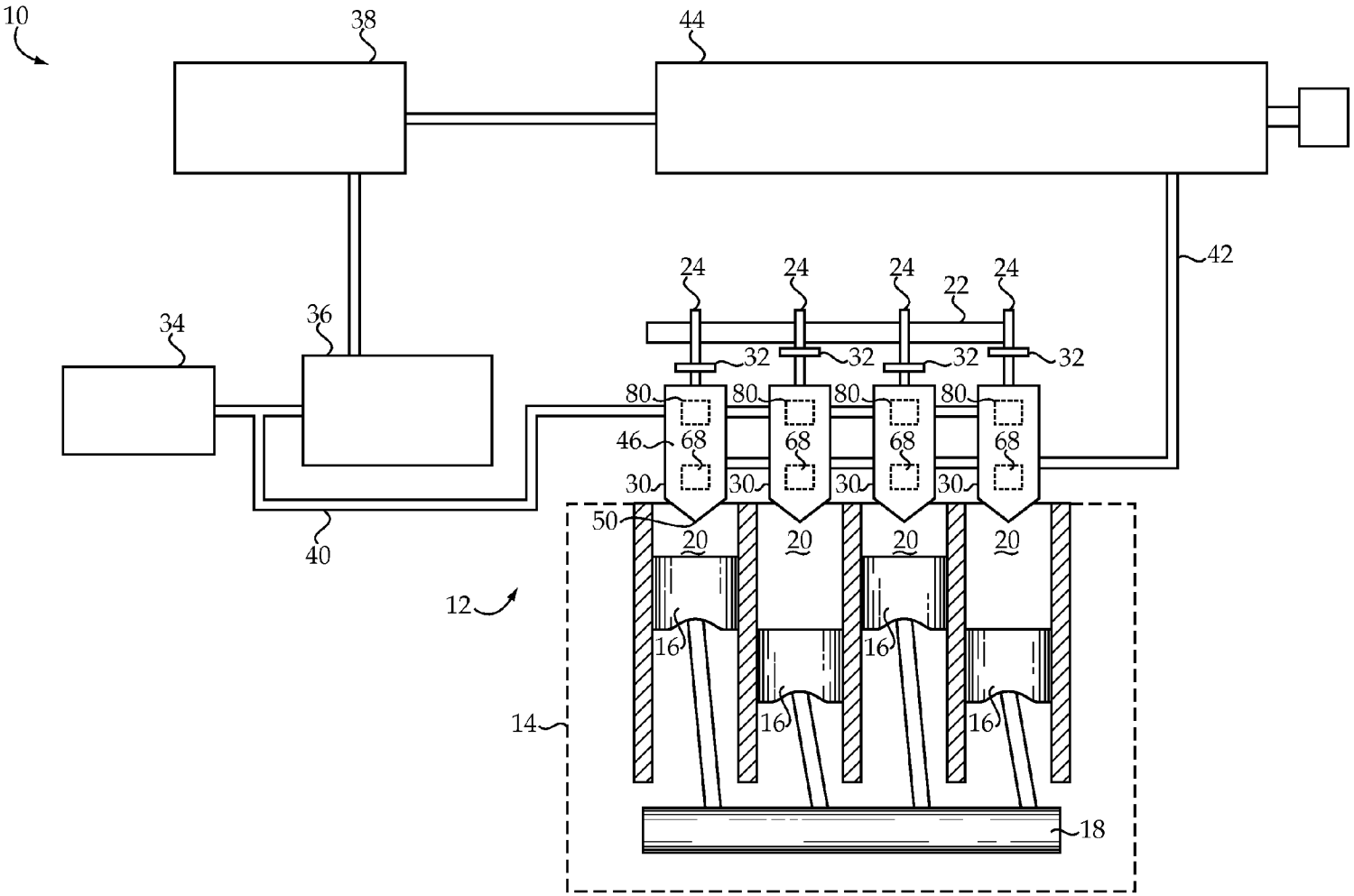
FIG. 1 is a side diagrammatic view of an internal combustion engine, according to one embodiment.

Referring to FIG. 1, there is shown an internal combustion engine 10 according to one embodiment. Internal combustion engine 10 may include a direct injection compression ignition diesel engine, but might comprise a spark ignited engine, or an engine with a different injection strategy, in other embodiments. Engine 10 may include an engine housing 14 which includes a plurality of cylinders 20 disposed therein. A plurality of pistons 16 are associated one with each of cylinders 20, and are coupled with a crankshaft 18, in a conventional manner. A plurality of fuel injectors 30 are associated with each of cylinders 20, and each extend partially into a corresponding one of cylinders 20. In one embodiment, each of fuel injectors 30 may include an injector body 46 defining at least one nozzle outlet 50 located within the corresponding cylinder 20. Engine 10 may further include a fuel system 12 having a common rail 44 which is fluidly connected with each one of fuel injectors 30 via a high pressure fuel supply conduit 42. Fuel system 12 may further include a fuel tank 34, a low pressure fuel pump 36 and a high pressure fuel pump 38. A low pressure fuel supply conduit 40 may connect from low pressure pump 36 to each one of fuel injectors 30.

Engine 10 may further include a camshaft 22 rotatable via operating engine 10, and having a plurality of cam lobes 24 positioned thereon. Each of cam lobes 24 may rotate in contact with a tappet 32 of each one of fuel injectors 30, the significance of which is further described herein. Each of fuel injectors 30 may further include an injection pressure control mechanism 80 positioned therein which enables selection of a fuel injection pressure corresponding to a fuel pressure from common rail 44, or an intensified pressure from a pressure intensifier actuated via the corresponding tappet 32, and further described herein. Each fuel injector 30 may further include an outlet check (not shown in FIG. 1) and a check control valve 68 for operating the corresponding outlet check.

Figure 2:
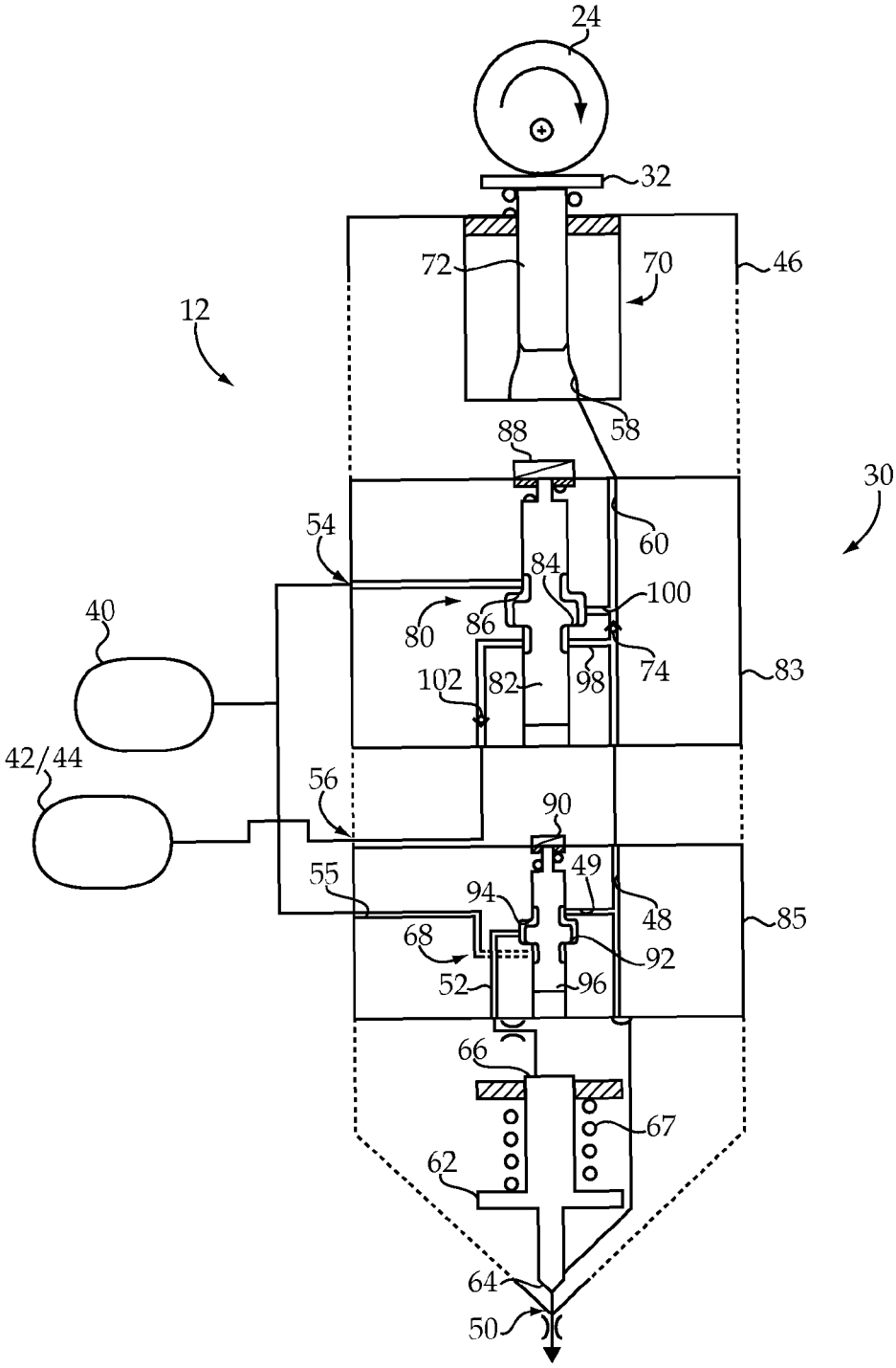
FIG. 2 is a side diagrammatic view of a fuel injector, according to one embodiment.

Referring now to FIG. 2, there is shown a portion of fuel system 12 including one of fuel injectors 30 illustrated in more detail. As mentioned above, each fuel injector 30 may include an injector body 46. Injector body 46 may define a nozzle supply passage 48, and nozzle outlet 50 which connects with nozzle supply passage 48. Injector body 46 may further define a control passage 52 and a low pressure space 54. In the illustrated embodiment, low pressure space 54 connects with or is part of low pressure fuel supply conduit 40. Injector body 46 may further define at least one fuel inlet 56, connecting with common rail 44, and also connecting with nozzle supply passage 48. Injector body 46 may further define a plunger cavity 58 and a pressure intensification passage 60 connecting plunger cavity 58 with nozzle supply passage 48 within injector body 46. Fuel injector 30 may further include an outlet check comprising a direct control needle check 62 positioned therein and movable between a closed position blocking nozzle outlet 50 from nozzle supply passage 48, and an open position. Direct control needle check 62 may further include an opening hydraulic surface 64 exposed to a fluid pressure of nozzle supply passage 48, and a closing hydraulic surface 66 exposed to a fluid pressure of control passage 52.

Fuel injector 30 may further include a check control valve 68 movable between a first injection control position at which control passage 52 is blocked from low pressure space 54 and a second injection control position at which control passage 52 is open to low pressure space 54. A low pressure outlet or drain 55 is shown connecting between check control valve 68 and low pressure fuel supply conduit 40/low pressure space 54.

Fuel injector 30 may further include a mechanically actuated pressure intensifier 70 positioned partially within injector body 46. Mechanically actuated pressure intensifier 70 includes tappet 32 and also includes a plunger 72. Plunger 72 is configured to move between a first plunger position and an advanced plunger position within plunger cavity 58, in response to rotation of cam lobe 24, which is rotatably coupled with cam 22. Fuel injector 30 may also include a first one-way valve 74 positioned fluidly between pressure intensification passage 60 and nozzle supply passage 48 and permitting fluid flow from plunger cavity 58 to nozzle supply passage 48. A second one-way valve 102 may be positioned fluidly between high pressure inlet 56 and a bidirectional passage 100, and permits fluid flow from high pressure inlet 56 to bidirectional passage 100. Bidirectional passage 100 can fluidly connect pressure intensification passage 60, and hence plunger cavity 58, with either of fuel inlet 56 or low pressure space 54, in a manner and for reasons further described herein.

Fuel injector 30 may further include an injection pressure control mechanism 80 having a first pressure control configuration and a second pressure control configuration. Injection pressure control mechanism 80 blocks plunger cavity 58 from fuel inlet 56 and fluidly connects plunger cavity 58 with low pressure space 54 by way of bidirectional passage 100 in the first pressure control configuration. Injection pressure control mechanism 80 fluidly connects plunger cavity 58 with fuel inlet 56 by way of bidirectional passage 100, and blocks plunger cavity 58 from low pressure space 54 in the second pressure control configuration.

In one embodiment, injection pressure control mechanism 80 may include a poppet valve 82 movable within a valve body component 83 of fuel injector 30. Injector body 46 may define a first seat 84 and a second seat 86. The first pressure control configuration may include a first poppet valve position at which poppet valve 82 contacts first seat 84, and the second pressure control configuration may include a second poppet valve position at which poppet valve 82 contacts second seat 86. Injection pressure control mechanism 80 may further include a first electrical actuator 88 coupled with poppet valve 82 and configured to move poppet valve 82 between the first poppet valve position and the second poppet valve position, alternately contracting seat 84 or seat 86.

In the embodiment shown, a single poppet valve 82 is depicted as part of injection pressure control mechanism 80. Poppet valve 82 may be spring biased toward its first position. It should be appreciated that other embodiments are contemplated where, for example, a plurality of valves are used in place of a single poppet valve. In still other embodiments, one or more slide-type valves such as spool valves might be used. It should thus be appreciated that a single poppet valve movable between a first seat and a second seat is but one illustrative embodiment, and the present disclosure is not thereby limited. Similarly, a medium pressure supply passage 98 is shown connecting fuel inlet 56 with nozzle supply passage 48 within valve body component 83, however, an alternative strategy might be used such as connecting nozzle supply passage 48 with fuel inlet 56 through another portion of injector body 56.

As mentioned above, fuel injector 30 may also include check control valve 68 therein. A second electrical actuator 90 may be coupled with check control valve 68 and configured to move check control valve 68 between the first and second injection control positions. Injector body 46 may further define a third seat 92 and a fourth seat 94. Check control valve 68 may include a second poppet valve 96 movable within a second valve body component 85 of fuel injector 30, and contacting third seat 92 at the first injection control position and contacting fourth seat 94 at the second injection control position.

INDUSTRIAL APPLICABILITY

The foregoing description of an example fuel injector 30 described in connection with FIG. 2 should be understood to refer similarly to each of fuel injectors 30 used in internal combustion engine 10. Likewise, the following description of example operation of fuel injector 30 should be understood to refer similarly to each of fuel injectors 30, as well as the overall operation of fuel system 12. With continued reference to FIG. 2, fuel injector 30 is shown as it might appear just prior to commencement of fuel injection during an engine cycle. Cam lobe 24 is rotating in contact with tappet 32 and causing plunger 72 to move between a retracted position and an advanced position. In the particular configuration shown, plunger 72 is illustrated approximately as it might appear at the refracted position having just drawn fuel at low pressure into plunger cavity 58. Fuel is supplied at the medium pressure from common rail 44 to fuel inlet 56 and to nozzle supply passage 48 by way of passage 98.

Poppet valve 82 is shown in the first pressure control position at which poppet valve 82 contacts first seat 84. As described herein, with poppet valve 82 at the first pressure control position, plunger cavity 58 is connected with low pressure space 54 by way of pressure intensification passage 60, and bi-directional passage 100. Fuel at medium pressure in nozzle supply passage 48 urges one way valve 74 toward a closed position at which nozzle supply passage 48 is blocked from pressure intensification passage 60. One-way valve 102 permits fuel at the medium pressure to flow from fuel inlet 56 to nozzle supply passage 48, at least until such time as fuel pressure in nozzle supply passage 48 becomes equal to the medium pressure.

In FIG. 2, poppet valve 96 is shown in its first injection control position contacting third seat 92. As a result, control passage 52 is blocked from drain 55, and fuel at the medium pressure may exert a closing hydraulic force on closing hydraulic surface 66. In one embodiment, needle check 62 may be hydraulically balanced by forces acting on closing hydraulic surface 66 and opening hydraulic surface 64. A biasing spring 67 may maintain needle check 62 in a closed position blocking nozzle outlet 50 from nozzle supply passage 48. In other embodiments, needle check 62 might be held closed at least in part by a relatively greater hydraulic force on closing hydraulic surface 66 than the force acting on opening hydraulic surface 64, such as by using different sized closing versus opening hydraulic surfaces.

When it is desirable to inject fuel into an associated engine cylinder 20 at a medium pressure, second electrical actuator 90 may be energized to move poppet valve 96 away from third seat 92 and towards fourth seat 94. Upon poppet valve 96 contacting fourth seat 94, control passage 52 will be blocked from nozzle supply passage 48, and open to drain 55. As a result, fuel pressure in nozzle supply passage 48 can act on opening hydraulic surface 64 to move needle check 62 towards an open position and thereby allow fuel to be injected via nozzle outlet 50. To end fuel injection, electrical actuator 90 may be de-energized, allowing poppet valve 96 to move back towards its first injection control position contacting third seat 92. The aforementioned fuel injection process may take place with poppet valve 82 maintained at its first pressure control position contacting first seat 84. It should be appreciated that injection of fuel at the medium pressure may take place irrespective of cam angle, and thus independently of a position or state of pressure intensifier 70. Thus, injection at the medium pressure may take place while plunger 72 is advancing, retracting or stationary. One-way valve 74 may block plunger cavity 58 from nozzle supply passage 48 during injecting fuel at the medium pressure, as well as any other time where fuel pressure is greater in nozzle supply passage 48 than in pressure intensification passage 60 and plunger cavity 58.

When it is desirable to inject fuel at a high pressure, electrical actuator 88 may be energized to move poppet valve 82 to its second pressure control position, fluidly connecting plunger cavity 58 with common rail 44 by way of bi-directional passage 100, and blocking plunger cavity 58 from low pressure space 54. Moving poppet valve 82 to the second pressure control position may, but need not, take place just prior to or while plunger 72 is retracting. When poppet valve 82 is moved to its second pressure control position, fuel at the medium pressure may flow by way of one way valve 102, bi-directional passage 100 and pressure intensification passage 60 into plunger cavity 58. It will be recalled that plunger 72 is displacing fuel at low pressure to and from low pressure space 54 in response to rotation of cam lobe 24 so long as poppet valve 82 is in its first pressure control position. Fluidly connecting plunger cavity 58 with common rail 44, however, will increase a pressure of fuel in plunger cavity 58 from the low pressure to the medium pressure. Increasing the pressure of fuel from the low pressure may take place while plunger 72 is stationary or retracting. Rotation of cam lobe 24 may be causing plunger 72 to move in a retracting direction, or causing no movement of plunger 72 during increasing the pressure in cavity 58 from the low pressure to the medium pressure, depending upon the profile of cam lobe 24. One-way valve 74 may block plunger cavity 58 from nozzle supply passage 48 during increasing a pressure of fuel in plunger cavity 58 from the low pressure to the medium pressure.

In response to further rotation of cam lobe 24 tappet 32 and plunger 72 may move in an advancing direction, and a pressure of fuel in plunger cavity 58 may be increased from the medium pressure to a high pressure. In other words, cam lobe 24 will tend to drive plunger 72 downwardly in the FIG. 2 illustration, increasing fuel pressure in plunger cavity 58 above rail pressure since plunger cavity 58 is blocked from low pressure space 54 and one-way valve 102 will tend to move toward a closed position when the pressure from bi-directional passage 100 rises above rail pressure. When it is desirable to inject fuel into the associated engine cylinder 20 at the high pressure, electrical actuator 90 may be energized to move poppet valve 96 from the first injection control position contacting seat 92 to the second injection control position contacting seat 94, in a manner similar to injecting fuel at the medium pressure. Since fuel pressure in pressure intensification passage 60 will tend to rise above the rail pressure resident in nozzle supply passage 48, nozzle outlet 50 will become fluidly connected with plunger cavity 58 by moving one-way valve 74 to an open position. De-energizing electrical actuator 90 will allow fuel injection at the high pressure to end. It may be noted that a fluid connection exists between control passage 52 and nozzle supply passage 48 when poppet valve 96 contacts third seat 92. In a practical implementation strategy, poppet valve 96 may be hydraulically balanced. In other embodiments, the plumbing strategy and/or relative sizes of orifices influencing moving poppet valve 96 between its first and second positions, or the sizing of hydraulic surfaces on poppet valve 96, might be varied to make poppet valve 96 hydraulically biased toward its first position or second position, or to provide a damping effect to motion of poppet valve 96. Such modification may be made according to known techniques.

Following injecting fuel at the high pressure, fuel system 12 may be operated in a low leakage mode. Operating fuel system 12 in a low leakage mode may be understood as returning fuel system 12 to a state at which pressure intensifier 70 is displacing fuel to and from low pressure space 54, and thus returning pressure in plunger cavity 58 to low pressure. To commence operation in the low leakage mode, poppet valve 82 may be returned to the first pressure control position, contacting seat 84. Operation in the low leakage mode may be essentially continuous, except where a high pressure injection is desired, improving over designs where a pressure intensifier continuously pumps at high pressure.

Figure 3:
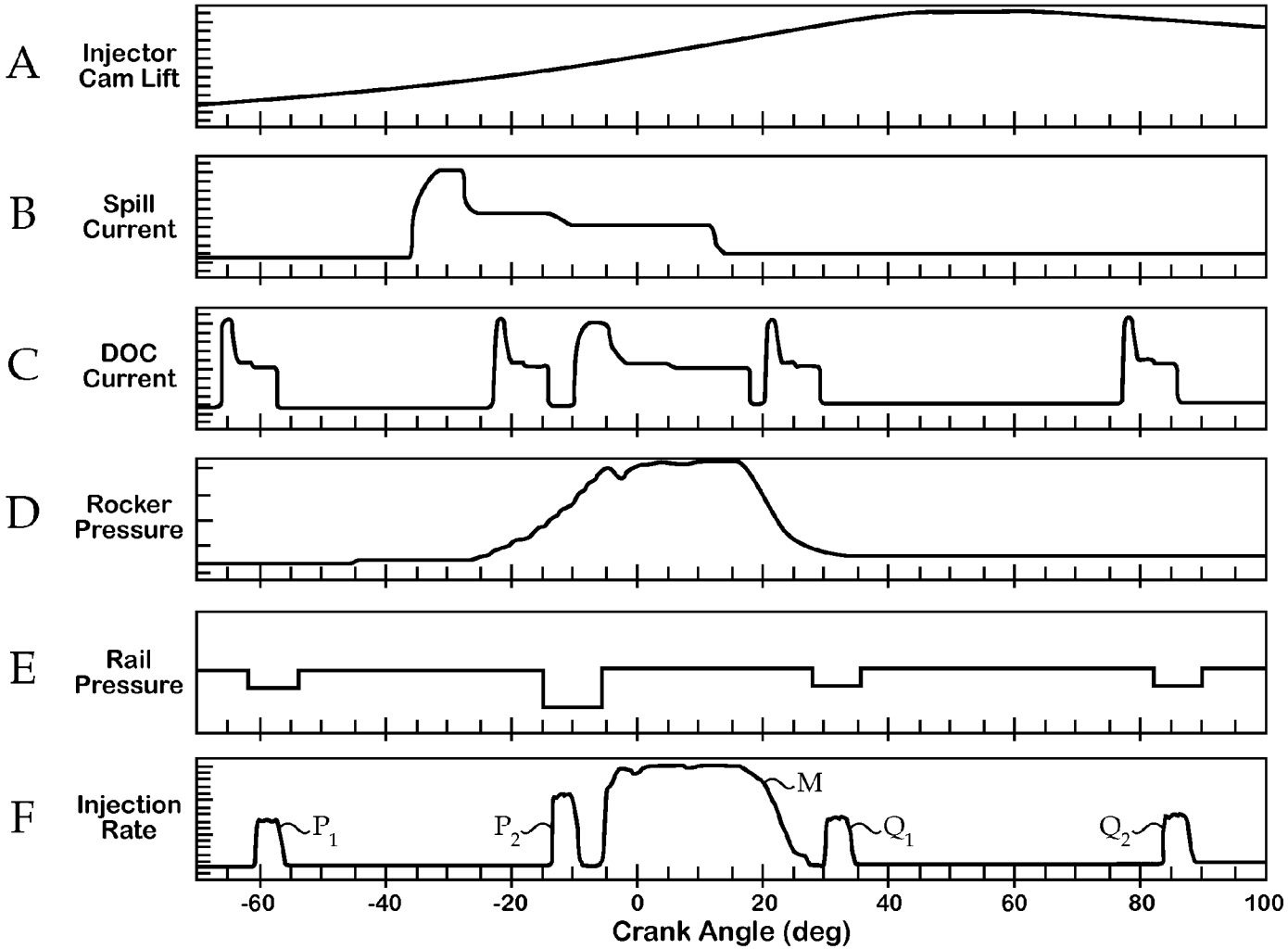
FIG. 3 is a diagram illustrating signal values for a plurality of different fuel system parameters, according to one embodiment.

In one embodiment, operating fuel system 12 may include injecting fuel a plurality of times while autoignition conditions exist in one engine cycle. As mentioned above, engine 10 may include a direct injection compression ignition engine. Injecting fuel multiple times in an engine cycle may include injecting one or more pilot injections or pre-injections, a main injection and one or more post-injections. Pre-injections and post-injections may take place for purposes known in the art, such as for controlling emissions. Referring also to FIG. 3, there are shown signal traces for a plurality of operating parameters of engine 10 during an example multiple injection engine cycle. Line A represents cam lift, Line B represents a current to electrical actuator 88 or a spill current, and Line C represents a current to electrical actuator 90 or a direct operated check current. Line D represents rocker pressure, which may correspond to a pressure in plunger cavity 58 as might be measured by a strain gauge coupled with an associated rocker arm. Line E represents rail pressure and Line F represents injection rate. In FIG. 3, the X axis represents crank angle. All the parameters illustrated in FIG. 3 may be measured or monitored by known techniques.

It may be noted that a main injection M begins at about −5° crank angle, and terminates at approximately 25° crank angle. A first pre-injection $P_1$ occurs at approximately −60° crank angle, whereas a second pre-injection $P_2$ occurs at approximately −15° crank angle. Pre-injections $P_1$ and $P_2$ may occur during a compression portion of an engine cycle. A first post injection $Q_1$ takes place at approximately 30° crank angle, and a second post injection $Q_2$ occurs at approximately 85° crank angle. Post injections $Q_1$ and $Q_2$ may take place during an expansion portion of an engine cycle. The fuel quantity and injection pressure of main injection M may be greater than that of injections $P_1$, $P_2$, $Q_1$ and $Q_2$.

It may further be noted that Line C, representing current to electrical actuator 90, reflects a plurality of periods of elevated current corresponding with each of the injection events shown via Line F. It may also be noted that energizing electrical actuator 90 for main injection M lasts relatively longer than for injections $P_1$, $P_2$, $Q_1$ and $Q_2$. In the embodiment shown, main injection M includes an injection at high pressure, while pre-injection $P_1$, and the post injections $Q_1$ and $Q_2$ include injections at medium pressure. Pre-injection $P_2$ may include an injection at an elevated pressure between medium pressure and high pressure. Line D, representing current to electrical actuator 88, reflects a period of elevated current where poppet valve 82 is moved to and held at the second poppet valve position contacting seat 86. With electrical actuator 88 energized, pressurization of fuel from the low pressure to the medium pressure can occur in plunger cavity 58. This is followed by pressurization of fuel in plunger cavity 58 from the medium pressure to the high pressure as plunger 72 is advanced. Pre-injection $P_2$ may occur while pressurization of fuel in cavity 58 is occurring, thus the pressure of pre-injection $P_2$ may be greater than the medium pressure but less than the high pressure. It may further be noted that current is supplied to electrical actuator 88, shown via line B, beginning approximately at −45° crank angle, and continuing to approximately 15° crank angle. Rail pressure, line E, exhibits pressure drops corresponding with each of pre-injections $P_1$ and $P_2$, as well as post injections $Q_1$ and $Q_2$. Rail pressure exhibits a relatively more pronounced drop at about −15° to about −5° crank angle, which denotes the supplying of fuel at medium pressure into plunger cavity 58.

As noted above, in the embodiment shown, injections $P_1$, $Q_1$ and $Q_2$ are all common rail injections, at medium pressure, and injection $P_2$ is at an elevated pressure, part way between the medium pressure and the high pressure of main injection M. In a practical implementation strategy, the relative precision of common rail injections $P_1$, $Q_1$ and $Q_2$, coupled with the elevated pressure injection $P_2$ and intensified main injection M, may be advantageous. Those skilled in the art will appreciate that a wide variety of injection patterns and pressure profiles other than those specifically described herein will be possible in view of the present disclosure. For instance, while main injection M is shown as a square front end and ramp-shaped back end injection, alternatives are possible. A hybrid main injection where a first part of a main injection occurs at medium pressure but a latter part occurs at high pressure, or the reverse, may be possible. Further, multiple post injections or pre-injections from common rail 44 at medium pressure might be used which are relatively more closely coupled than that depicted in FIG. 3. $P_2$ might also be a medium pressure injection from common rail 44, rather than the elevated pressure shown.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A method of operating a fuel system for an internal combustion engine comprising the steps of:

injecting fuel into an engine cylinder at a medium pressure level at least in part by fluidly connecting a nozzle outlet of a fuel injector with a common rail containing the fuel at the medium pressure level;

increasing a pressure of fuel in a plunger cavity of the fuel injector from a low pressure level existing in the plunger cavity during the medium pressure injection to the medium pressure level by fluidly connecting the plunger cavity with the common rail;

increasing a pressure of fuel in the plunger cavity from the medium pressure level to a high pressure level by moving a tappet of a mechanically actuated pressure intensifier in response to rotation of a cam;

injecting fuel at the high pressure level into the engine cylinder at least in part by fluidly connecting the nozzle outlet with the plunger cavity; and operating the fuel system in a low leakage mode subsequent to the injection of fuel at the high pressure level at least in part via a step of returning a pressure of fuel in the plunger cavity from the high pressure level to the low pressure level.

2. The method of claim 1 wherein the step of operating the fuel system in a low leakage mode further includes the steps of supplying fuel into the plunger cavity from a low pressure space at least in part by moving the tappet in a first direction in response to rotation of the cam, and displacing fuel from the plunger cavity to the low pressure space at least in part by moving the tappet in a second direction in response to further rotation of the cam.

3. The method of claim 2 wherein the step of increasing the pressure of fuel from a low pressure level further includes a step of moving a poppet valve from a first pressure control position at which the poppet valve contacts a first seat to a second pressure control position at which the poppet valve contacts a second seat, and wherein the step of returning a pressure further includes a step of returning the poppet valve from the second position to the first position.

4. The method of claim 3 wherein the step of moving the poppet valve further includes energizing a first electrical actuator coupled with the poppet valve, and wherein each of the steps of injecting fuel further includes energizing a second electrical actuator coupled with a needle control valve for a direct control needle check of the fuel injector.

5. The method of claim 4 wherein the needle control valve includes a second poppet valve, and wherein each of the steps of injecting fuel further includes moving the second poppet valve from a first injection control position contacting a third seat to a second injection control position contacting a fourth seat.

6. The method of claim 4 wherein the step of injecting fuel at the high pressure level further includes the steps of:

moving the direct control needle check from a closed position blocking the nozzle outlet from a nozzle supply passage to an open position via a pressure of fuel in the nozzle supply passage acting on an opening hydraulic surface of the needle check; and moving the direct control needle check from the open position to the closed position via a pressure of fuel in a control passage acting on a closing hydraulic surface of the needle check, the pressure level of fuel in the control passage being equal to the high pressure level.

7. The method of claim 6 wherein the step of increasing a pressure of fuel from the low pressure level further includes increasing the pressure level of fuel in the plunger cavity while a plunger of the mechanically actuated pressure intensifier is stationary or retracting.

8. The method of claim 7 further comprising the steps of:

blocking the plunger cavity from the nozzle supply passage with a one-way valve during the step of increasing a pressure level of fuel from the low pressure level; and blocking the plunger cavity from the nozzle supply passage with the one-way valve during the step of injecting fuel at the medium pressure level;

wherein the step of injecting fuel at the high pressure level further includes moving the one-way valve from a first one-way valve position blocking the plunger cavity from the nozzle supply passage to a second one-way valve position at which the plunger cavity is fluidly connected with the nozzle supply passage.

9. The method of claim 8 further comprising a step of blocking the common rail from the plunger cavity with a second one-way valve during the step of injecting fuel at the high pressure level.

10. The method of claim 1 wherein:

the step of injecting fuel at the high pressure level includes injecting fuel a first time in an engine cycle while autoignition conditions exist in the engine cylinder; and the method further including a step of injecting fuel a second time in the engine cycle while autoignition conditions exist, and the step of injecting fuel a second time includes injecting fuel at the medium pressure level.

11. The method of claim 10 wherein:

injecting fuel a first time includes injecting a relatively greater quantity of fuel; and the step of injecting fuel a second time includes injecting a relatively smaller quantity of fuel in an expansion portion of the engine cycle.

12. A fuel injector comprising:

an injector body defining a nozzle supply passage, a nozzle outlet connecting with the nozzle supply passage, a control passage and a low pressure space, the injector body further defining at least one fuel inlet connecting with the nozzle supply passage, a plunger cavity and a pressure intensification passage connecting the plunger cavity with the nozzle supply passage within the injector body;

a direct control needle check positioned within the injector body and movable between a closed position blocking the nozzle outlet from the nozzle supply passage and an open position, the direct control needle check having an opening hydraulic surface exposed to a fluid pressure in the nozzle supply passage and a closing hydraulic surface exposed to a fluid pressure in the control passage;

a check control valve movable between a first injection control position at which the control passage is blocked from the low pressure space and a second injection control position at which the control passage is open to the low pressure space;

a mechanically actuated pressure intensifier positioned partially within the injector body, the mechanically actuated pressure intensifier including a tappet and a plunger configured to move between a first plunger position and an advanced plunger position within the plunger cavity, in response to rotation of a cam;

a one-way valve positioned fluidly between the pressure intensification passage and the nozzle supply passage and permitting fluid flow from the plunger cavity to the nozzle supply passage; and an injection pressure control mechanism having a first pressure control configuration and a second pressure control configuration;

wherein in the first pressure control configuration the injection pressure control mechanism blocks the plunger cavity from the at least one fuel inlet, fluidly connects the at least one fuel inlet with the nozzle outlet, and fluidly connects the plunger cavity with the low pressure space; and wherein in the second pressure control configuration the injection pressure control mechanism fluidly connects the plunger cavity with the at least one fuel inlet and blocks the plunger cavity from the low pressure space.

13. The fuel injector of claim 12 wherein the injection pressure control mechanism includes a poppet valve and the injector body defines a first seat and a second seat, and wherein the first pressure control configuration includes a first poppet valve position at which the poppet valve contacts the first seat and the second pressure control configuration includes a second poppet valve position at which the poppet valve contacts the second seat.

14. The fuel injector of claim 13 further comprising a first electrical actuator coupled with the poppet valve, and a second electrical actuator coupled with the check control valve.

15. The fuel injector of claim 14 wherein the injector body defines a third seat and a fourth seat, the check control valve including a second poppet valve contacting the third seat at the first control valve position and contacting the fourth seat at the second control valve position.

16. The fuel injector of claim 12 wherein:

the injector body defines a high pressure supply passage fluidly connecting the at least one high pressure inlet with the nozzle supply passage, and the injector body further defines a bidirectional passage fluidly connecting with the pressure intensification passage; and the injection pressure control mechanism blocks the bidirectional passage from the at least one high pressure inlet and fluidly connects the bidirectional passage with the low pressure space in the first pressure control configuration, and the injection pressure control mechanism fluidly connects the bidirectional passage with the at least one high pressure inlet and blocks the bidirectional passage from the low pressure space in the second pressure control configuration.

17. The fuel injector of claim 16 further comprising a second one-way valve positioned fluidly between the at least one high pressure inlet and the bidirectional passage and permitting fluid flow from the at least one high pressure inlet to the bidirectional passage.

18. A fuel system for an internal combustion engine comprising:

a plurality of fuel injectors, each of the fuel injectors including an injector body defining a nozzle supply passage, a nozzle outlet and a fuel inlet each connecting with the nozzle supply passage, a low pressure space, and a plunger cavity;

a plurality of one-way valves each positioned fluidly between one of the plunger cavities and the nozzle supply passage in the corresponding injector body and permitting fluid flow from the plunger cavity to the nozzle supply passage;

a plurality of mechanically actuated pressure intensifiers each including a tappet and being positioned partially within the plunger cavity of one of the injector bodies;

a common rail fluidly connecting with the fuel inlet of each of the fuel injectors and containing a fuel at a medium pressure level; and each of the fuel injectors further having an injection pressure control mechanism which includes an injection pressure control valve movable between a first pressure control position and a second pressure control position;

wherein each of the injection pressure control valves blocks the corresponding pressure intensifier from the common rail and fluidly connects the pressure intensifier with the low pressure space at the first pressure control position, such that fuel within the plunger cavity is at a low pressure level and an injection of the fuel from the corresponding nozzle outlet occurs at the medium pressure level at the first pressure control position; and wherein each of the injection pressure control valves fluidly connects the pressure intensifier with the common rail and blocks the pressure intensifier from the low pressure space at the second pressure control position, such that fuel within the plunger cavity is at a high pressure level and an injection of the fuel via the corresponding nozzle outlet occurs at the high pressure level at the second pressure control position.

19. The fuel system of claim 18 further comprising:

a second plurality of one-way valves each being disposed fluidly between the common rail and one of the pressure intensifiers and permitting fuel flow from the common rail to the one of the pressure intensifiers.

20. The fuel system of claim 18 wherein each of the injection pressure control mechanisms includes an electrical actuator, and each of the injection pressure control valves includes a poppet valve coupled with the electrical actuator and being movable between the first pressure control position and the second pressure control position by energizing the electrical actuator, each of the injector bodies further defining a first seat and a second seat, the poppet valve contacting the first seat at the first pressure control position and contacting the second seat at the second pressure control position.

21. The fuel system of claim 19 wherein:

each of the fuel injectors further includes a direct control needle check, a second electrical actuator and a check control valve which includes a second poppet valve coupled with the second electrical actuator and being movable between a first control valve position and a second control valve position by energizing the second electrical actuator; and each of the injector bodies further defines a third seat, a fourth seat and a control passage, the second poppet valve contacting the third seat and blocking the control passage from the low pressure space at the first control valve position, and the second poppet valve contacting the fourth seat and fluidly connecting the control passage with the low pressure space at the second control valve position.

* * * * *

UNITED STATES PATENT AND TRADEMARK OFFICE

CERTIFICATE OF CORRECTION

PATENT NO. : 8,443,780 B2
APPLICATION NO. : 12/791179
DATED : May 21, 2013
INVENTOR(S) : Coldren et al.

It is certified that error appears in the above-identified patent and that said Letters Patent is hereby corrected as shown below:

In the Specification

Column 4, lines 49-61, delete "In one embodiment, injection..... pressure.....poppet valve position, alternately contracting seat 84 or seat 86." and insert the same after "pressure control configuration." on line 48 as a continuation of paragraph.

Signed and Sealed this
Twenty-fifth Day of August, 2015

Michelle K. Lee

Michelle K. Lee
*Director of the United States Patent and Trademark Office*